US005367757A

United States Patent [19]

Liu

[11] Patent Number: 5,367,757

[45] Date of Patent: Nov. 29, 1994

[54] FOLDABLE RIVETER FRAME

[76] Inventor: Yang-Ting Liu, No. 76-1, 4 Lin, Shang-Guan Li, Yuan Li, Miao-Li Hsien, Taiwan, Prov. of China

[21] Appl. No.: 167,075

[22] Filed: Dec. 15, 1993

[51] Int. Cl.[5] ..... B21J 15/38

[52] U.S. Cl. ..... 29/243.527

[58] Field of Search ..... 29/243.527

[56] References Cited

FOREIGN PATENT DOCUMENTS 0606825 8/1948 United Kingdom ..... 29/243.527

0155754 3/1954 United Kingdom ..... 29/243.527

*Primary Examiner*—David Jones

*Attorney, Agent, or Firm*—Morton J. Rosenberg; David I. Klein

[57] ABSTRACT

A folding heavyweight riveter includes a base frame assembly, a pull shaft driven to move axially relative to the base frame assembly in moving riveting elements to set rivets or rivnuts, two rollers mounted on the pull shaft at two opposite sides by two clamping plates, two folding handles bilaterally pivoted to the base frame assembly, two links linked between the handles and the clamping plates, wherein each handle is comprised of a front handle frame, an intermediate handle frame pivoted to the front handle frame, and a grip connected to the intermediate handle frame, and a lock device to lock the front and intermediate handle frames in the operative position.

4 Claims, 4 Drawing Sheets

FOLDABLE RIVETER FRAME

BACKGROUND OF THE INVENTION

The present invention relates to riveters, and more particularly to a folding heavyweight riveter for setting rivets and rivnuts.

A variety of riveters have been disclosed, and have appeared on the market. FIG. 1 shows a riveter according to the prior art which is generally comprised of two handles 60 pivoted to a casing 50 thereof, a pull shaft 51 linked between the handles 60 by links 52 and rollers 53;54. As the handles 60 are turned inwards toward each other or outwards from each other, the pull shaft 51 is moved in either direction, and therefore a riveting operation is performed. The installation of the rollers 53;54 greatly reduces the friction, however, the rollers 53;54 cannot sustain heavy pressure. Because the rollers 53 are directly pressed by the handles 60, they may be damaged easily. Another drawback of this structure of riveter is that the elongated handles 60 occupy much storage space.

SUMMARY OF THE INVENTION

The present invention eliminates the aforesaid disadvantage. It is therefore one object of the present invention to provide a folding heavyweight riveter which is durable in use. It is another object of the present invention to provide a folding heavyweight riveter which can be folded up to reduce its storage space when it is not in use.

According to the preferred embodiment of the present invention, the folding heavyweight riveter comprises a base frame assembly having two lugs symmetrically disposed at two opposite sides; a pull shaft connected to a rear end of the base frame assembly and moved axially relative to the base frame assembly; two rollers fastened to the pull shaft at two opposite sides by two clamping plates, each roller having a roller shaft connected between the clamping plates at either side; two folding handles respectively pivoted to the lugs; two links having each one end pivoted to either handle and an opposite turned about the roller shaft of either roller; wherein each handle is comprised of a front handle frame, an intermediate handle frame, and a grip, the front handle frame having a front end pivoted to either lug and a rear end made with a pivot hole and an end notch, the front handle frame further comprising a unitary push block disposed in contact with either roller, the intermediate handle frame having a front end fastened with a pivot inserted in the pivot hole on the front handle frame and a rear end connected to the grip and an inner side wall fastened with a lock device, the lock device comprising a latch having an oblong hole in the middle and a front end releasably engaged into the end notch on the front handle frame, a bolt inserted through the oblong hole on the latch into a side hole on the intermediate handle frame, and a rubber cushion mounted around the bolt and retained between the intermediate handle frame and the latch. By pulling the latch backwards to release its front end from the end notch on the front handle frame, the handle can be folded up to reduce its storage space.

DETAILED DESCRIPTION OF THE PREFERRED EMBODIMENT

Figure 1:
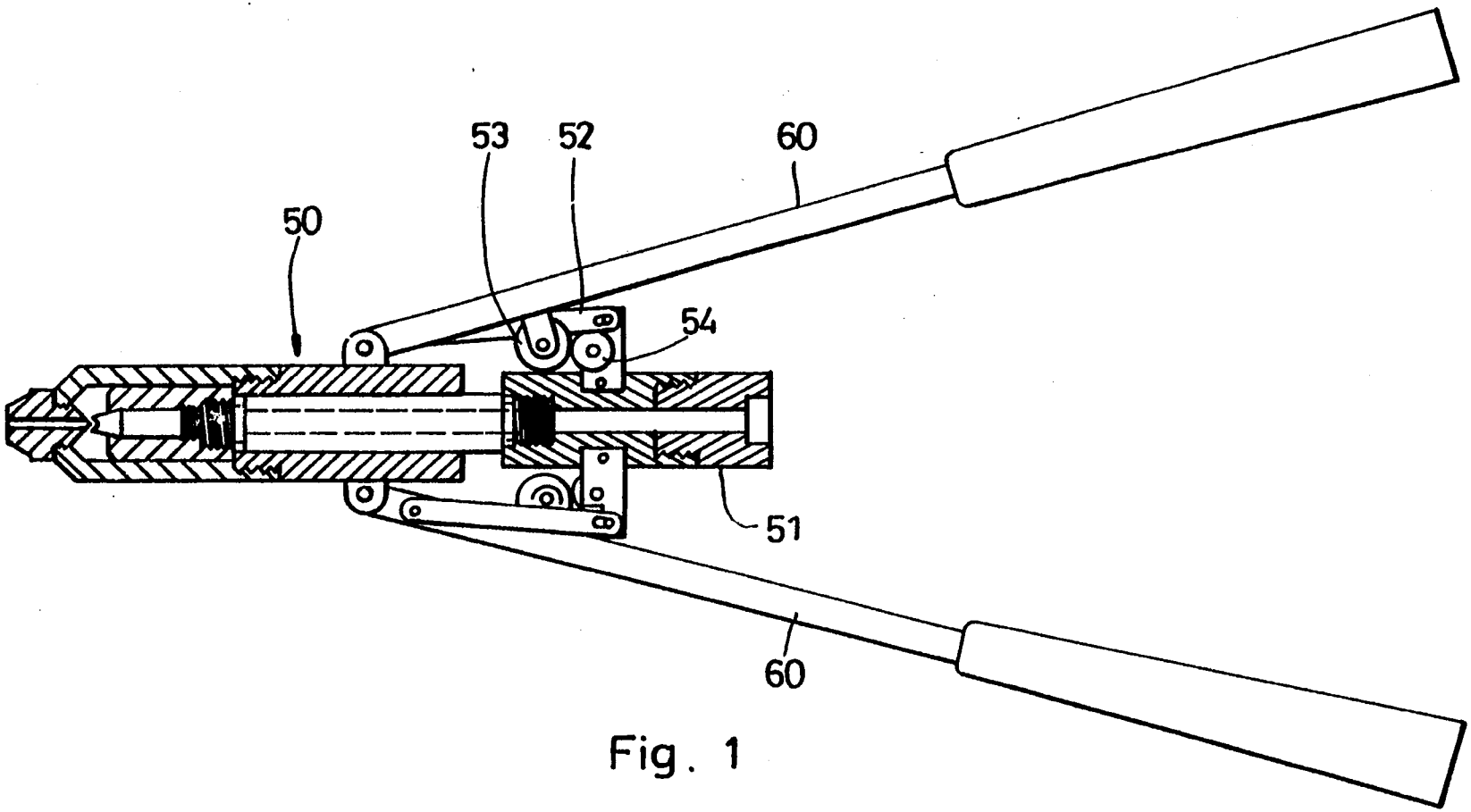
FIG. 1 is a plan view of a riveter according to the prior art.
Figure 2:
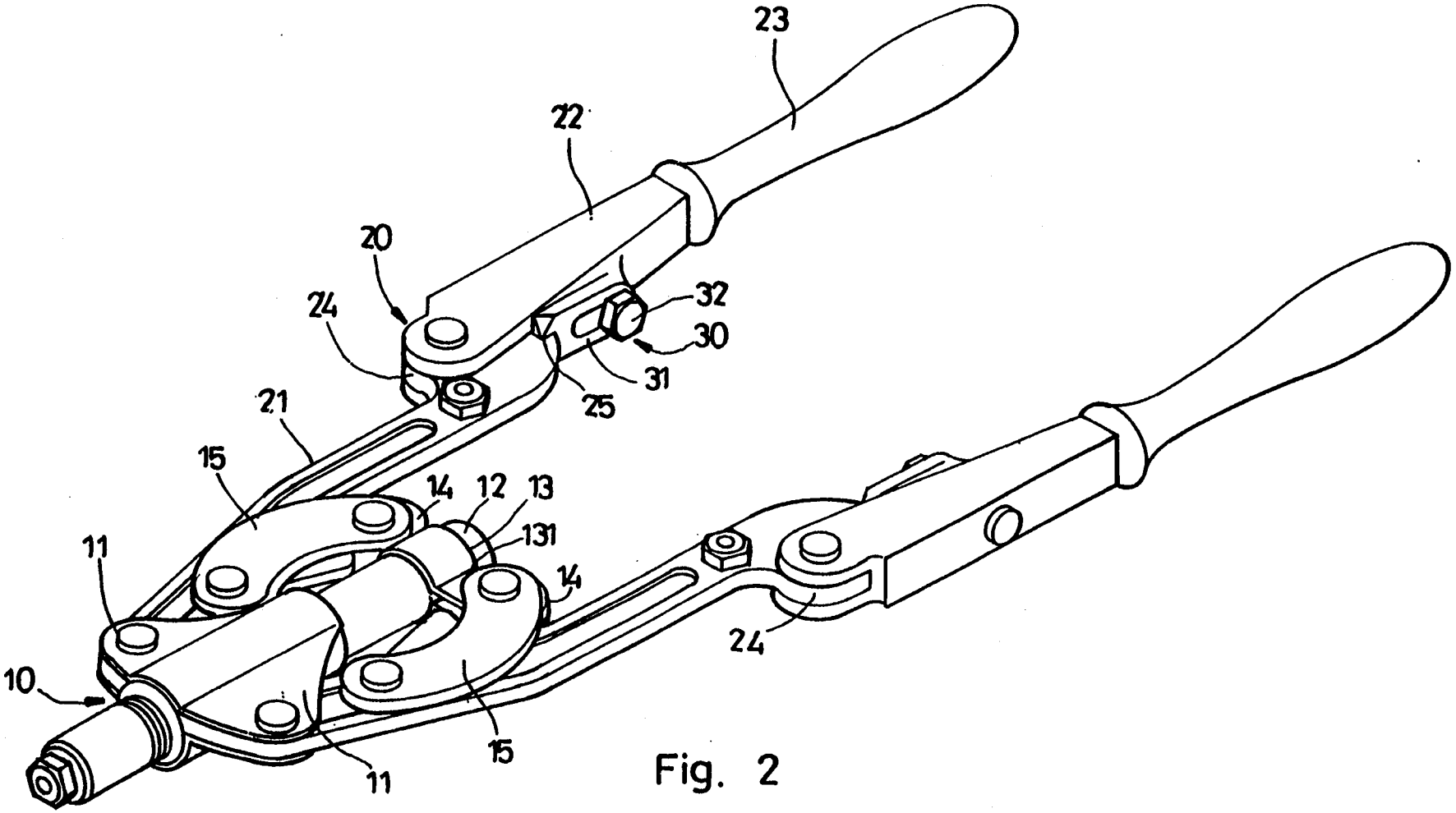
FIG. 2 is an elevational view of a folding heavyweight riveter according to the preferred embodiment of the present invention.
Figure 3:
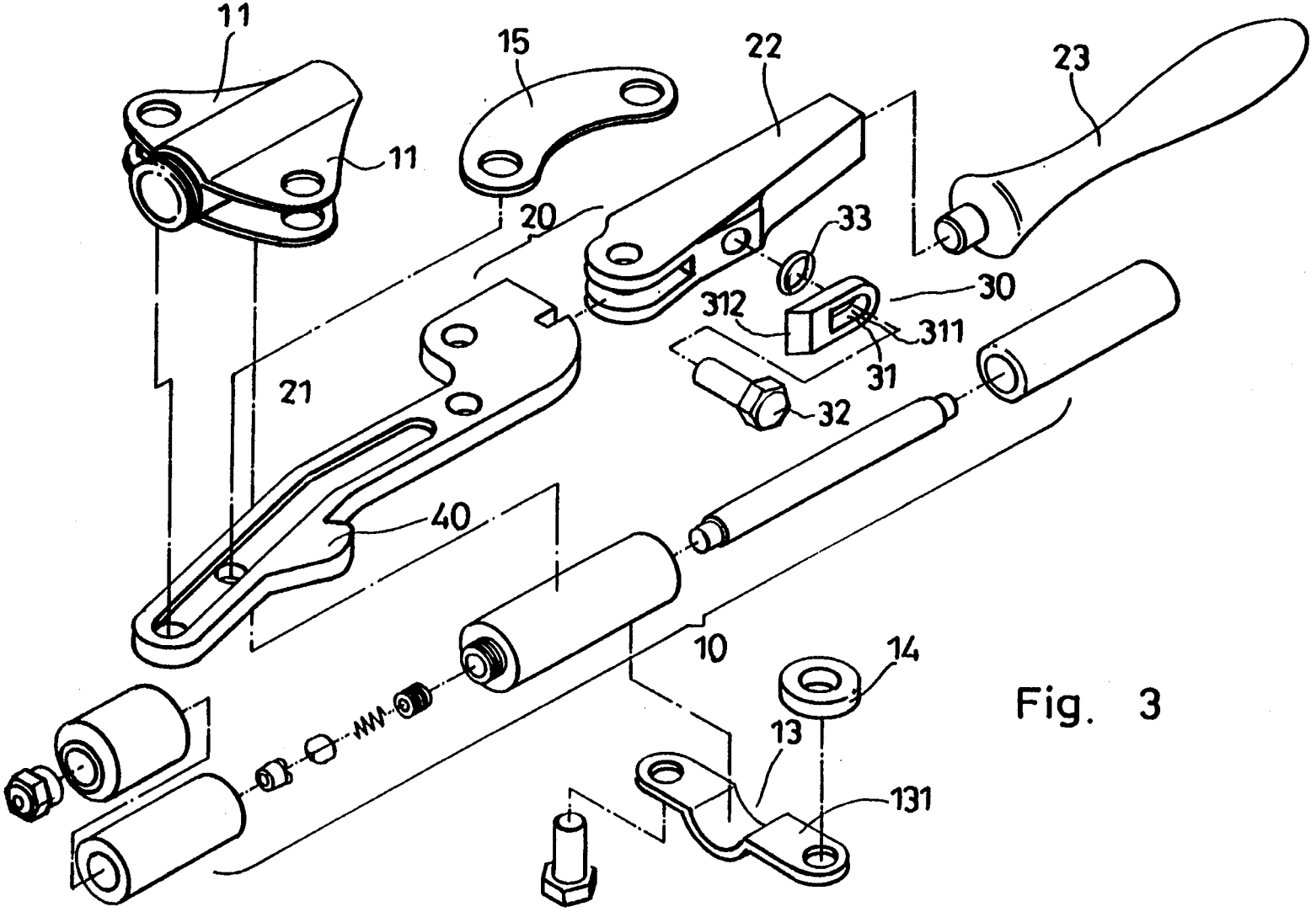
FIG. 3 is an exploded view of the folding heavyweight riveter shown in FIG. 2.
Figure 4:
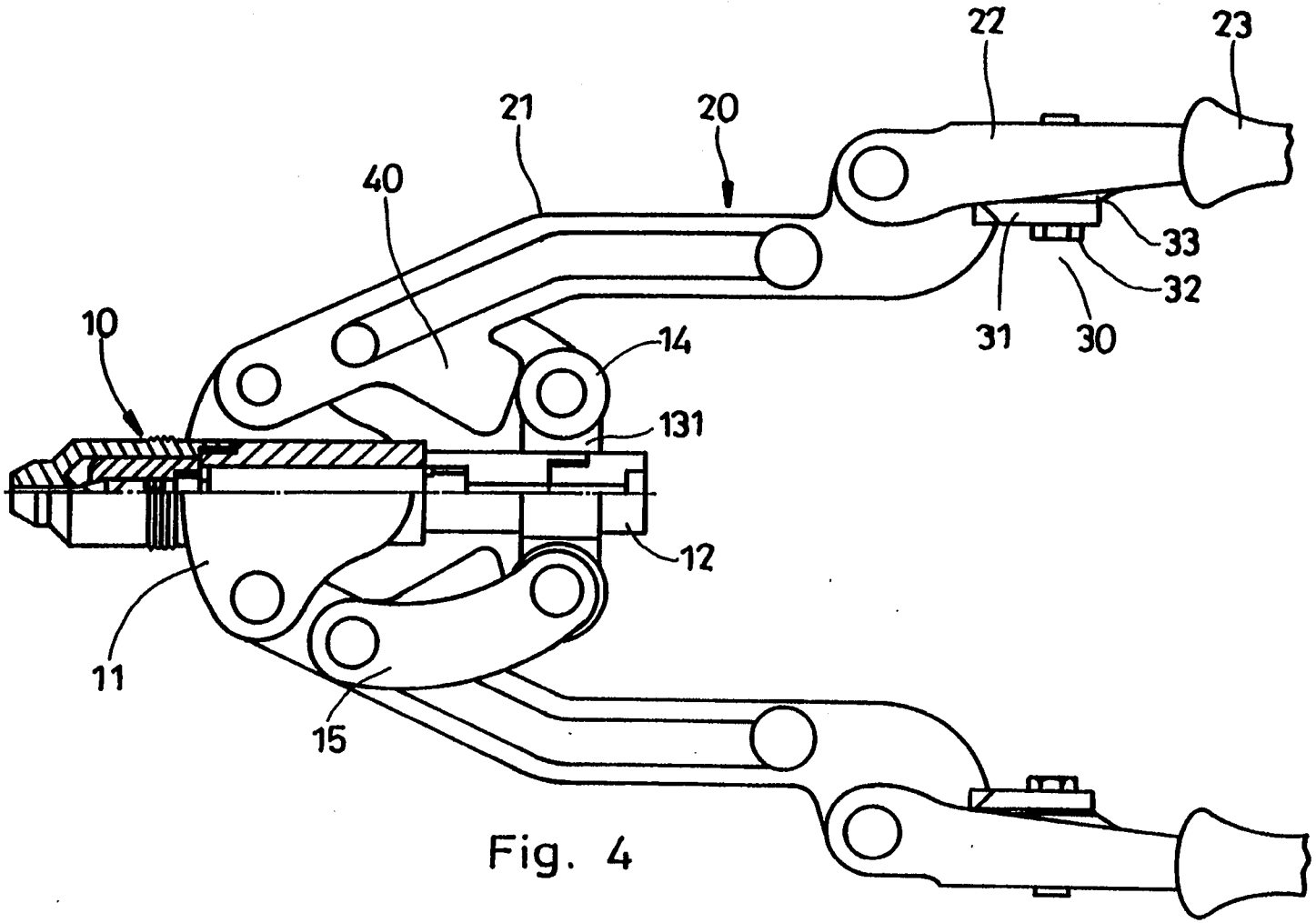
FIG. 4 is a partial sectional view of the folding heavyweight riveter of FIG. 2.

Referring to FIGS. 2 and 3, a folding heavyweight riveter in accordance with the present invention is generally comprised of a cylindrical base frame assembly 10, a pull shaft 12, and two handles 20.

The base frame assembly 10 comprises two lugs 11 symmetrically disposed at two opposite sides. The pull shaft 12 is connected to the base frame assembly 10 and moved axially relative to the base frame assembly 10. Two clamping plates 13 are fastened to the pull shaft 12 at two opposite sides to hold two rollers 14 between two opposite ends thereof. The handles 20 are respectively pivoted to either lug 11. Each handle 20 is comprised of a front handle frame 21, an intermediate handle frame 22, and a grip 23. There are two links 15 connected between the front handle frame 21 of either handle 20 and the clamping plates 13 at either end. The front handle frame 21 has a front end pivoted to either lug 11 and a rear end made with a pivot hole 24, which is pivoted to the intermediate handle frame 22, and an end notch 25. The grip 23 is longitudinally fastened to the opposite end of the intermediate handle frame 22. The intermediate handle frame 22 comprises a lock device 30 at an inner side near the end notch 25 of the front handle frame 21. The lock device 30 comprises a latch 31 having an oblong hole 311 in the middle and a sloping front end 312, a bolt 32 inserted through the oblong hole 311 of the latch 31 to fasten the latch 31 to the intermediate handle frame 22 at an inner side, and a rubber cushion 33 mounted around the bolt 32 and retained between the latch 31 and the intermediate handle frame 22. When assembled, the sloping front end 312 of the latch 31 engages into the end notch 25 on the front handle frame 22 to stop the intermediate handle frame 11 from being moved relative to the front handle frame 21. The front handle frame 21 comprises a unitary push block 40 at an inner side disposed in contact with either roller 14.

When in operation, the pressure employed by the user to the handles 20 is directly transmitted through the push blocks 40 to the rollers 14. Because the push blocks 40 are integrally made on the front handle frames 21 of the handles 20, they are very strong and will not be damaged easily. Because the front and intermediate handle frames 21;22 of each handle 20 are pivoted together, the handles 20 can be folded up to minimize the storage space when the riveter is not in use. Because the bolt 32 is inserted through the oblong hole 311 on the latch 31 and the latch 31 is supported on the rubber cushion 33, the latch 31 can be moved backwards to release the sloping front end 312 from the end notch 25 on the front handle frame 21 for permitting the front handle frame 21 and the intermediate handle frame 22 to be folded up. The handle 20 can also be conveniently turned from the collapsed position to the operative positive by turning the front and intermediate handle frames 21;22 relative to each other permitting them to be longitudinally aligned and then pushing the latch 31 forwards to engage the sloping front end 312 into the end notch 25 on the front handle frame 21 again. Of course, the front end of the latch 31 may be made of any of a variety of shapes that fits into the end notch 25 on the front handle frame 21.

The cylindrical base frame 10 is a known structure having elements driven by the pull shaft 12 to set rivets or rivnuts.

While only one embodiment of the present invention has been shown and described, it will be understood that various modifications and changes could be made without departing from the spirit and scope of the invention.

What is claimed is:

1. A foldable riveter frame, said riveter frame having a nose piece and collet arrangement for receiving and pulling a rivet therein, said frame comprising:

(a) a longitudinally extended base frame assembly having a pair of lug members extending from opposing sides thereof;

(b) a pull shaft secured in a rear end of said base frame assembly and reversibly displaceable in said longitudinal direction relative to said base frame assembly and adapted to be connected to to said collet arrangement for pulling said rivet;

(c) a pair of clamping plates clamped to said pull shaft, said clamping plates having a pair of rollers located on respective roller shafts and mounted between said clamping plates on opposing sides of said pull shaft and in contact therewith;

(d) foldable handle means for folding said riveter frame, said foldable handle means including a pair of frontal handle frames, a pair of intermediate handle frames and a pair of grip members, each of said frontal handle frames having a front end section mounted pivotally to a respective one of said lug members, and a rear end section having a pivot through opening and a notch formed within an end surface thereof, each of said frontal handle frames further having an extension push block member for contacting a respective roller and displacing said shaft, each of said intermediate handle frames having a respective front end pivotally connected, by way of a pivot pin passing through said pivot through opening, to said frontal handle frame and a rear end connected to a respective one of said grip members;

(e) a pair of link members pivotally coupled on a first end to a respective frontal handle frame and on a second opposing end to a respective roller shaft; and, (f) locking means mounted to each of said intermediate handle members for fixedly coupling each of said intermediate handle members to each of said frontal handle members, said locking means including a latch member having a longitudinally directed oblong opening passing therethrough a bolt member for passing through said oblong opening into a securement hole formed in said intermediate handle frame member, and a rubber cushion member between said latch member and said intermediate handle member, said latch member having a frontal end for releasable engagement within said notch formed within said end surface of said frontal handle member.

2. The foldable riveter frame as recited in claim 1 wherein said latch member is lockingly engaged to said frontal handle member by longitudinal insert of said latch member frontal end into said notch.

3. The foldable riveter frame as recited in claim 2 where said latch member frontal end includes a predetermined contour for slidable engagement into said notch.

4. The foldable riveter frame as recited in claim 3 where said latch member frontal end includes an inclined substantially planar contour.

* * * * *